United States Patent [19]

Caillerie et al.

[11] Patent Number: 4,699,815

[45] Date of Patent: Oct. 13, 1987

[54] PROCESS OF GALVANIZATION OF TEMPERED STEEL CONTAINING SILICON

[75] Inventors: Jean-Louis Caillerie, Montigny-Le-Bretonneux; Remy Decaens, Maurepas; Armand Limare, Aubigny-Au-Bac, all of France

[73] Assignee: Societe Anonyme Dite Societe Miniere et, Paris, France

[21] Appl. No.: 938,041

[22] Filed: Dec. 4, 1986

Related U.S. Application Data

[62] Division of Ser. No. 592,347, Mar. 22, 1984, Pat. No. 4,636,354, which is a division of Ser. No. 491,810, May 5, 1983, abandoned.

[30] Foreign Application Priority Data

May 5, 1982 [FR] France ..... 82-07772

[51] Int. Cl.[4] ..... C23C 2/06

[52] U.S. Cl. ..... 427/433

[58] Field of Search ..... 427/433

[56] References Cited

U.S. PATENT DOCUMENTS

| | | | |
|---|---|---|---|
| 2,197,622 | 4/1940 | Sendzimir | 420/514 |
| 3,245,765 | 4/1966 | Lawson | 428/659 |
| 4,389,463 | 6/1983 | Smeggil et al. | 428/659 |

FOREIGN PATENT DOCUMENTS

| | | |
|---|---|---|
| 0046458 | 8/1980 | European Pat. Off. . |
| 1558489 | 7/1970 | Fed. Rep. of Germany . |
| 1548017 | 10/1968 | France . |
| 2366376 | 4/1978 | France . |

OTHER PUBLICATIONS

Metals Handbook, 8th Edition, vol. 2, "Heat Treating Cleaning and Finishing", American Society for Metals, 1964, p. 498.

The Making, Shaping and Treating of Steel, United States Steel, 1971, pp. 1028–1041.

Metals Handbook, Ninth Edition, vol. 5, "Surface Cleaning, Finishing and Coating", American Society for Metals, 1982, pp. 323–332.

Galvanizing Handbook, E. I. DuPont DeNemours & Co., 1981, Ch. 4, pp. 8–12.

*Primary Examiner*—Sam Silverberg

*Attorney, Agent, or Firm*—Fleit, Jacobson, Cohn & Price

[57] ABSTRACT

Disclosed herein is an alloy for galvanizing objects of steel which have a concentration of silicon lower than 0.45% by weight. The alloy consists essentially of 0.5 to 1.5% by weight of lead, 0.005 to 0.2% by weight of germanium and the balance zinc. The alloy may further contain 0.001 to 0.05% by weight aluminum.

6 Claims, 2 Drawing Figures

PROCESS OF GALVANIZATION OF TEMPERED STEEL CONTAINING SILICON

This is a divisional of application Ser. No. 592,347 filed Mar. 22, 1984 now U.S. Pat. No. 4,636,354, which is a divisional of application Ser. No. 491,810, filed May 5, 1983, now abandoned.

The present invention concerns the galvanization of objects formed of steel, especially a type containing silicon in a concentration which can reach 0.45% in weight. More specifically, the invention concerns a process of galvanization, the galvanized objects formed by its application, as well as an alloy used for the application of this process.

The galvanization of tempered steels containing less than 0.04% in weight of silicon poses no problems of any importance concerning the quality of the coating formed thereby. In particular, the main properties possessed by coatings formed thereby are: a shiny appearance, good resistance to corrosion, good adherence to the substratum, and a thickness on the order of 70 to 90 and capable of reaching 120 micrometers.

It has been observed for a long time that the galvanization of steels containing more than 0.04% in weight of silicon posed problems. These steels are known in the technical trade under the names of the semi-killed steel, containing up to 0.1% of silicon approximately, of killed steel, whose density in silicon is between 0.1 and 0.2%, and of steel with a high density in silicon.

At the time of galvanization of these types of steel with the help of baths usually used for rimmed steels (less than 0.04% of silicon), it is observed that the coatings of zinc often have a grey appearance which is a sign of the formation of intermetallic compounds, giving a fragility to the coating. This not only does not have a shiny appearance, but it resists corrosion very poorly and adheres poorly to the substratum. Very often, the coatings and formed have an excessive thickness, of several hundred micrometers.

Research has already been carried out to solve these problems posed by the galvanization of steels containing silicon. For example, resource has been made to the process of using a preheating of the objects to be galvanized in a bath of melted salts as well as a galvanization at a high temperature, in a ceramic crucible. The application of these procedures is very costly, and they do not provide results which can be duplicated. In addition, galvanization at high temperatures produces the formation of a sizable amount of ashes.

This process does permit the galvanization of steels containing up to 0.2% of silicon with thicknesses greater than or equal to the norms currently in use, without having to maintain a narrow fork of aluminium in the fusion bath. The same is not the case when one wishes to galvanize steels containing more than 0.2% of silicon.

The invention concerns a process of galvanization which, in contrast to the previously mentioned process, adapts even to pieces with a high density in silicon, which may reach 0.45% of silicon in weight, in the presence of a weak amount of germanium incorporated in the bath. The bath includes also, to good effect, some lead and possibly some aluminium. One obersees, in fact, that the germanium has an important influence on the reactions of the iron-zinc pair, in the presence or the absence of aluminium. One observes, in addition, that the combination of lead and germanium gives to the galvanization bath a fluidity and a surface tension which are very high, which permit the application of galvanization at a lower temperature than that which is currently used, especially around 440° C.

More precisely, the invention concerns a process of galvanization of objects of steel, of the type which include the treatment of the surface of the objects to be galvanized, then their immersion in a galvanization bath; this process includes regulating the composition of the bath so that it contains 0.005 to 0.2% in weight of germanium, and regulating the temperature of the bath between about 440° and 460° C., preferably between 440° and 450° C.

The composition of the bath is with good effect regulated so that the bath contains 0.5 to 1.5% in weight of lead, and preferably also 0.001 to 0.05% in weight of aluminium.

In a particularly helpful example, the composition of the galvanization bath is regulated so that this bath contains, in weight percentages, 0.03 to 0.15% of germanium and 0.8 to 1.2% of lead, with good effect in the presence of 0.001 to 0.01% of aluminium.

This regulation of the composition of the bath is preferably carried out by the addition of suitable amounts of at least one mother alloy.

The treatment of the surface, previous to the immersion in the galvanization bath, includes only the normal operations of surface treatment before galvanization, especially cleaning, scouring, rinsing, and flushing.

The previously mentioned process is suited not only to steels having average or high densities in silicon but also steels containing only very little, especially rimmed steels.

It also has been observed that the application of the galvanization process according to the invention permitted the formation of objects of galvanized steel in which germanium has a special, characteristic distribution.

More specifically, the invention concerns also objects of galvanized steel, of the type which includes a body of rimmed steel semi-killed or killed with silicon, forming a substratum, and a coating of galvanization with a stratified structure including, beginning with the substratum, a layer of intermetallic compounds of iron and zinc, and a layer having markedly a constant composition; the layer of intermetallic compounds contains germanium whose concentration varies in the thickness of this layer, with this concentration being greatest on the one hand at a distance from the interface of the substratum and the layer of intermetallic compounds, and on the other hand with the distance from the interface of this layer of intermetallic compounds and the layer of markedly uniform composition.

The invention also concerns an object of galvanized steel, including a body of killed steel with silicon or with a high density in silicon, which can reach 0.45% in weight, with this body forming a substratum, and a covering of galvanization with a polyphased structure in which 0.005 to 0.2% of germanium is dispersed practically throughout its thickness.

The thickness of the covering formed on these objects of galvanized steel is helpfully between 60 and 120 micrometers.

The invention also concerns an alloy designed for the application of the previously mentioned process, i.e. tempered galvanization of objects of steel whose density in silicon is lower than 0.45%, with this alloy containing, in addition to zinc and in weight percentages, 0.5 to 1.5% of lead, 0.005 to 0.2% of germanium and 0.001 to 0.05% of aluminium. Preferably, this alloy contains, in weight percentages, 0.8 to 1.2% of lead, 0.03 to 0.15% of germanium and 0.001 to 0.01% of aluminium.

Other characteristics and advantages of the invention will be better apparent from the description of specific examples of the application and the detailed description which follows, carried out in reference to the attached drawing, in which.

Figure 1:
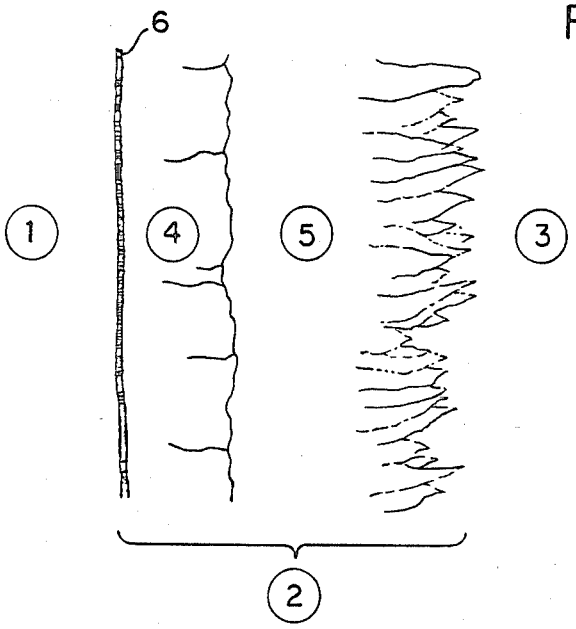
FIG. 1 is a schematic cut-away drawing, very enlarged, of one part of a galvanized object according to the invention.

FIG. 1 is a schematic cut-away drawing, enlarged on the order of 1,000, of a part of an object galvanized according to the invention. This object includes a substratum, 1, of steel, for example of a semi-killed or killed steel. This substratum carries a caating which includes a layer, 2, of intermetallic compounds and an external layer, 3, whose surface has not been represented, and which has a markedly uniform composition. The layer, 2, is represented with two sub-layers, 4 and 5, of different crystallographic characteristics.

In addition, especially for longer immersion times, one will note the presence of a slim sub-layer, a supplementary one, 6, directly in contact with the steel substratum 1. The entirety of these sub-layers, 4, 5, and possibly 6 form the "layer of intermetallic compounds."

Figure 2:
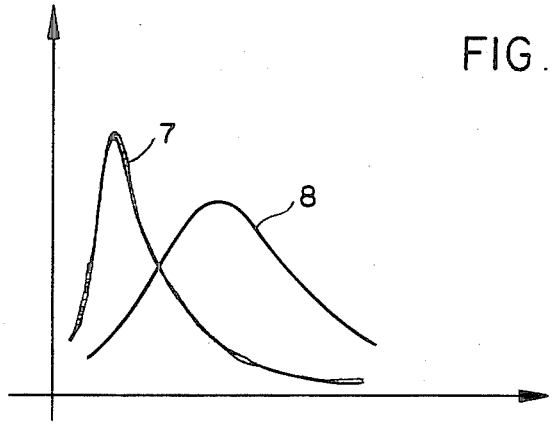
FIG. 2 is a graphic representing, in arbitrary units, the variation of the concentration in germanium in a coating layer of an object galvanized according to the invention.

FIG. 2 represents the variation of concentration of germanium in the layer of intermetallic compounds represented in FIG. 1. The abscissas correspond to the distances measures from the sub-layer, 6. The curve, 7, represents the variation in concentration of germanium in the case of a galvanized object during a short immersion time, for example on the order of one minute at 440° C. In this case, the maximum concentration is found in the sub-layer, 4. When the structure represented in FIG. 1 is obtained after a longer time of immersion, on the order of five minutes, for example the layer, 2, has then a greater thickness but markedly the same composition, and the curve of distribution of germanium, done by reference 8 on FIG. 2, indicates a maximum concentration in the sub-layer 5.

One observes, in characterstic fashion, according to the invention, that this maximum is found in one of the sub-layers, 4 and 5, in general in proximity to their interface, but always in the layer of intermetallic compounds, 2, and at a distance from the interfaces on the one hand with the body, 1, of steel and on the other hand, with the external layer, 3, of markedly uniform composition.

In the case of steels with a high density in silicon, for example between 0.2 and 0.45% in weight, one observes a structure of the type represented in FIG. 1 only when the immersion time is very short. After several minutes of immersion, the germanium diffuses and has a distribution much more regular in the entire thickness of the sub-layer 2. This is, besides, much less well defined and one no longer observes the stratified structure represented in FIG. 1, but rather a polyphased structure.

This behavior of germanium is original to the extent that, on the one hand, the technical literature makes no reference to it and on the other hand, this behavior distinguishes itself from that of other elements added to baths of zinc, and especially from that of aluminium. One knowns that this reduces the reactivity of zinc vis-a-vis silicon steels. In particular, it has been observed that adding aluminium modified the reaction kinetics.

It seems that the action of germanium, especially combined with lead, in the weight percentages indicated, is more an adsorption of germanium at the interface of iron and zinc, and a regularization of the reactions on each side of this interface. Germanium diffuses then on either side of this interface, as the layer, 2, of intermetallic compounds is formed on one side and the other; the diffusion can finally produce a distribution which is nearly uniform, of the germanium, when the length of immersion time is sufficiently long, especially in the presence of an important amount of silicon, which accelerates the reactions. However, it is necessary to note that the main theme of the invention is no way limited by this interpretation.

Whatever the interpretation of the behavior of germanium, especially in the presence of lead, one observes that the alloy possesses a fluidity and a surface tension which are excellent, so much so that the temperature of the bath can be maintained at only 440° C., while the temperature which is usually necessary is from 450° to 470° C. The draining of the pieces poses scarcely any problems thanks to the fluidity of the bath. The coatings have an exceptional shine and they have an excellent adherence to the substratum.

Kinetic studies of the formation of the iron-zinc alloy beds have shown that, in a bath containing aluminium between 350 and 500 grams per ton, the presence of germaniumm involves an increase in the reaction kinetics of iron zinc for immersion times, at the time of galvanization, which are higher than five minutes, in particular for steels containing more than 0.2% of silicon.

In the case of a zinc containing 400 to 500 grams per ton of aluminium, the thickness of the coatings of zinc on steels containing more than 0.2% is in general lower than 70 micrometers and almost independent of the time in the zinc bath and of the galvanization temperatures usually used.

The presence of germanium in growing amounts in the zinc bath containing 400 to 500 grams per ton of aluminium increases the thickness of the zinc coatings obtained on steels with more than 0.2% of silicon.

This addition of germanium thus exercizes a helpful effect on the galvanization of steels with more than 0.2% of silicon in a zinc bath or an alloy bath containing aluminium.

The surface tension and the fluidity of this zinc containing some lead and germanium permit a lowering of the galvanization temperature on the order of ten degrees without changing the productivity of the galvanizer which, in the case of a classic zinc without germanium, is in general limited to a temperature of 450° C. when it galvanizes loads which are fairly heavy in relation to the volume of zinc contained in the vat.

The possibility of working at a lower temperature in the presence of germanium in a bath containing lead is favorable to the galvanization of steels containing silicon. In fact, at 440° C., the kinetics of lead-zinc reaction are weaker than those obtained at 450° C. on steels containing silicon.

The combination of elements Pb, Ge, Al in the alloy permits the galvanization of practically any kind of steel at temperatures from 440° to 450° C. approximately, with thicknesses between 70 and 200 micrometers.

When one galvanizes steels at 440° C., the density in aluminium must be between 250 and 350 grams per ton, while at 450° C. the aluminium must be between 400 and 500 grams per ton.

The following examples of application of the present invention, which are not exhaustive, have the goal of permitting specialists to determine easily the operating conditions which should be used in each specific case.

One uses in these examples samples 100 by 100 millimeters, having a thickness of 3 to 5 millimeters, formed of three different variants of steel, steel A being of rimmed type, steel B being a killed steel with silicon, and steel C being a steel with a high density in silicon. More specifically, the designation of these steels is as follows:

| SAMPLE | AFNOR DESIGNATION NORM | Si % |
|---|---|---|
| A | E 24.1 | traces |
| B | E 24.3 | 0.09 |
| C | E 26.4 | 0.248 |

All samples undergo, before galvanization properly speaking, i.e., immersion in the bath of melted zinc, a classic surface treatment. This treatment includes first of all a cleaning at 70° C. in an aqueous solution of 50 grams per liter of NaOH and 50 grams per liter of $Na_2CO_3$. The samples are then rinsed with running water at surrounding temperature.

Then then undergo a scouring in commercial chlorhydric acid of 50%, in the presence of a well known inhibitor, "Socospar" C 51, for 30 to 45 minutes. Then, the samples are rinsed in running water at room temperature.

The following treatment operation is a rinsing at 80° C., in a solution of 200 grams per liter of zinc chloride and 200 grams per liter of $NH_4Cl$. The samples are then dried in the oven at 100° C. and are ready to be used for galvanization.

Galvanization is carried out by immersion of the samples, for the time shown, in a bath contained in a crucible for 50 kilograms, having a capacity of one ton. The temperature of the galvanization bath is shown for each example and it is regulated at 2° C. more or less.

The composition of the galvanization baths is shown in the table which follows.

| Example | Pb% | Ge% | Al% | Other Elements |
|---|---|---|---|---|
| 1 and 2 | 0.26 | traces | 0.0008 | traces (0.0025% of Cd) |

-continued

| Example | Pb% | Ge% | Al% | Other Elements |
|---|---|---|---|---|
| 3 | 1.4 | 0.12 | 0.004 | 0.01% of total |
| 4 and 5 | 1.2 | 0.085 | 0.003 | traces |

The bath used in examples 1 and 2 includes only traces of germanium and thus does not permit the application of the invention. It is a question of a classical bath of Z7 composition, French standard A 53-101. This standard specifies especially the following composition:

Zn: 99.5% minimum
Pb: 0.5% maximum
Cd: 0.15% maximum
Fe: 0.02% Maximum
Sn: 0.002% maximum
Cu: 0.002% maximum The following standards define the qualities of zinc near zinc Z7:

| | | |
|---|---|---|
| Canada | HZ 2 | Special Brass (99.25%) |
| Spain | UNE 37301 | ZN 99.5 |
| U.S. | ASTM B6 | Special Brass (99%) |
| Japan | JIS H 2107 | Distilled Special (99.6)) |
| Italy | UNIMET III/025 | ZnA 99.5 |
| Fed. Republic of Germany | DIN 1706 | Zn 99.5 |
| United Kingdom | RS 3436 | Zn 3 |

The results of the examples are shown in the following table.

| Example | Temperature °C. | Immersion Time | Steel A Thickness* | Steel A Appearance | Steel B Thickness* | Steel B Appearance | Steel C Thickness | Steel C Appearance |
|---|---|---|---|---|---|---|---|---|
| 1 | 450 | 1 | 70 | white | 80 | marbled | 90 | grey |
| | | 4 | 80 | " | 105 | marbled grey | 240 | " |
| | | 8 | 100 | " | 385 | " | 350 | " |
| 2 | 440 | 1 | 70 | white | 70 | white | 100 | grey |
| | | 4 | 80 | " | 160 | " | 220 | " |
| | | 8 | 100 | " | 260 | " | 320 | " |
| 3 | 450 | 1 | 80 | shiny | 75 | shiny | 60 | shiny |
| | | 5 | 100 | " | 175 | " | 80 | " |
| 4 | 450 | 1 | 60 | shiny | — | — | — | — |
| | | 2 | — | — | 170 | shiny | 260 | shiny |
| | | 5 | 90 | " | — | — | — | — |
| 5 | 440 | 1 | 60 | shiny | 60 | shiny | 60 | shiny |
| | | 5 | 100 | " | 120 | " | 110 | " |

*in micrometers

One notes, first of all, that in the classic bath (examples 1 and 2) the coating has a suitable thickness and appearance solely in the case of the rimmed steels. In the case of the steels containing silicon, the coating has a great thickness which continues to grow even after long periods of immersion, and it has a grey or marbled appearance. These coatings are much too thick when the immersion time is long.

On the contrary, all the coatings obtained in examples 3, 4, and 5, i.e. carried out according to the invention, have a shiny appearance. Their thicknesses suit the classic coatings of galvanization. However, in example 4, the thicknesses obtained with steels B and C are excessively for the only immersion time which was tried. One attributes this excessive thickness to an excessively high reactivity, due to the temperature of 450° C. which shows itself to be too high in the case of these experimental conditions. Consequently, it is preferable that the bath temperature be reduced to 440° C. Example 5 differs from example 4 only by this reduction in temperature. One then notes that, even in the case of still steels and at a high density in silicon, the coatings obtained have a thickness perfectly suited in conditions of industrial use.

EXAMPLE 6

The galvanization of a new steel containing 0.38% of silicon and 450° C. for an immersion time of 5 minutes in a bath containing 1% of lead and variable densities in aluminium and germanium gave the following results:

| | | | |
|---|---|---|---|
| Al = 410 g/t | Ge = 0 | e = 30 | micrometers |
| Al = 410 g/t | Ge = 200 g/t | e = 50 | micrometers, shiny appearance |
| Al = 410 g/t | Ge = 360 g/t | e = 80 | micrometers, shiny appearance |

The same steel galvanized at 450° C. for 10 minutes in a bath containing 1% of lead and variable densities in aluminium and germanium gave the following results:

| | | | |
|---|---|---|---|
| Al = 410 g/t | Ge = 0 | e = 30 | micrometers |
| Al = 410 g/t | Ge = 200 g/t | e = 100 | micrometers, shiny appearance |
| Al = 410 g/t | Ge = 360 g/t | e = 150 | micrometers, shiny appearance |

Thus, these results show the main advantages of the invention. More specifically, the incorporation of germanium, helpfully in the presence of lead, permits the formation of completely satisfactory coatings and which correspond to the conditions set down by the users, even in the case of steels having a high density in silicon, which may reach 0.45%. Then, this coating is obtained without utilization of a particularly elaborate treatment since it applies only the operations used normally for the galvanization of steels without silicon. Then, the temperature of the bath is helpfully reduced to only 440° C. In these conditions, the amount of ashes formed is reduced and the output of the bath is increased.

Finally, the appearance of the galvanized objects is excellent because not only the coating is shiny, but is does not form drops or streaks along the length of the edges of the objects.

We claim:

1. Process of galvanization of steel surfaces having a concentration of silicon lower than 0.45% by weight comprising treating said steel surface prior to galvanizing by immersing said steel surface in a bath comprising 0.005 to 0.2% by weight germanium, 0.5 to 1.5% by weight lead and the balance zinc, and maintaining the temperature of the bath between approximately 440 and 460 degrees C.

2. Process according to claim 1 wherein the bath contains 0.001 to 0.05% in weight aluminum.

3. Process according to claim 1 wherein the bath contains 0.03 to 0.15% by weight germanium and 0.8 to 1.2% by weight lead.

4. Process according to claim 3 wherein the bath contains 0.001 to 0.01% by weight aluminum.

5. Process according to claim 1 wherein the steel is selected from the group consisting of effervescent steel, semi-killed steel, killed steel, and rimmed steel.

6. Process according to claim 1 wherein in said treatment includes cleaning, scouring, rinsing and flushing.

* * * * *

UNITED STATES PATENT AND TRADEMARK OFFICE

CERTIFICATE OF CORRECTION

PATENT NO. : 4,699,815

DATED : October 13, 1987

INVENTOR(S) : Caillerie et al

It is certified that error appears in the above-identified patent and that said Letters Patent is hereby corrected as shown below:

On the title page, the assignee should read:

--(73) Assignee: Societe Miniere et Metallurgique de Penarroya --

This certificate supersedes certificate of correction issued Nov. 8, 1988.

Signed and Sealed this

Seventh Day of March, 1989

*Attest:*

*Attesting Officer*

DONALD J. QUIGG

*Commissioner of Patents and Trademarks*